US007781667B2

(12) United States Patent
Shibata

(10) Patent No.: US 7,781,667 B2
(45) Date of Patent: Aug. 24, 2010

(54) ELECTRONIC WIND INSTRUMENT

(75) Inventor: Koichiro Shibata, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 57 days.

(21) Appl. No.: 12/141,981

(22) Filed: Jun. 19, 2008

(65) Prior Publication Data

US 2008/0314226 A1 Dec. 25, 2008

(30) Foreign Application Priority Data

Jun. 20, 2007 (JP) ..... 2007-162451

(51) Int. Cl.
*G10H 3/00* (2006.01)

(52) U.S. Cl. ..... 84/723

(58) Field of Classification Search ..... 84/723, 84/743

See application file for complete search history.

(56) References Cited

U.S. PATENT DOCUMENTS

| | | | | |
|---|---|---|---|---|
| 3,767,833 | A * | 10/1973 | Noble et al. | 84/673 |
| 4,970,931 | A | 11/1990 | Culbreath | |
| 5,543,580 | A * | 8/1996 | Masuda | 84/723 |
| 7,049,503 | B2 * | 5/2006 | Onozawa et al. | 84/723 |
| 2007/0137468 | A1 | 6/2007 | Shibata | |
| 2008/0314226 | A1 * | 12/2008 | Shibata | 84/384 |
| 2009/0288549 | A1 * | 11/2009 | Masuda et al. | 84/723 |

FOREIGN PATENT DOCUMENTS

| | | | |
|---|---|---|---|
| EP | 1748416 | A1 | 1/2007 |
| EP | 1760690 | A2 | 3/2007 |
| EP | 1801779 | A1 | 6/2007 |
| JP | 7199919 | | 8/1995 |
| JP | 2006343442 | | 12/2006 |
| JP | 2007017524 | | 1/2007 |
| JP | 2007017525 | | 1/2007 |
| JP | 2007171477 | | 7/2007 |
| JP | 2007193100 | | 8/2007 |
| WO | 2007/059614 | A1 | 5/2007 |

* cited by examiner

*Primary Examiner*—Jeffrey Donels
(74) *Attorney, Agent, or Firm*—Harness, Dickey & Pierce, PLC

(57) ABSTRACT

Electronic wind instrument includes a body section, and a blowing unit pivotably supported on the body section. The blowing unit includes a lip plate section that abuts with a lower lip part of a human player, and a blowing detection section that detects a flow rate of a breath blown by the human player. The blowing unit, which is pivotable about a longitudinal shaft of the body section, includes retaining elements that retain the blowing unit at a predetermined pivoting position, and scale marks for indicating a pivoting position of the blowing unit retained by the retaining elements.

9 Claims, 4 Drawing Sheets

ELECTRONIC WIND INSTRUMENT

BACKGROUND

The present invention relates to electronic wind instruments, such as electronic flutes.

As well known, the electronic wind instrument includes a blow hole that is simulative of a mouthpiece (or embouchure) of a natural wind instrument, a lip plate located near the blow hole, and a plurality of performing keys provided on a tubular body section. Once a human player blows a breath into the instrument through the blow hole with its lower lip part (i.e., lower lip and part neighboring the lower lip of the human player) contacting (abutting with) the lip plate, a tone pitch is identified in accordance with a fingering pattern that is a combination of depressed performing keys, and a tone of a volume corresponding to a flow rate of the blown breath is synthesized and sounded with the identified pitch. With such a type of electronic wind instrument, a function is required for stably detecting a flow rate of each breath blown by the human player. However, because the breath blown through the blow hole has a very small pressure, it is not easy to detect the pressure of the blown breath to determine a flow rate of the blown breath. Japanese Patent Application Laid-open Publication No. 2007-17524 discloses an electronic wind instrument which is constructed to direct a flow of a blown breath to a pressure sensor via a guide member in the shape of a megaphone. Further, in the electronic wind instrument disclosed in the No. 2007-17524 laid-open publication, a curved rail is fixed to the tubular body section so that the guide member is movable along the rail. With such an arrangement, a human player can adjust an orientation and position of the guide member by moving the guide member along the rail, which can facilitate breath blowing by the human player.

style in which to perform a natural wind instrument, such as a natural flute, differs among human players, which includes, for example, not only a performance style where the wind instrument is performed with the mouthpiece oriented upward but also a performance style with the mouth piece oriented toward the human player. Not only the orientation of the mouthpiece but also the position of the lip plate which the lower jaw is caused to contact also differs among human players. In the case of natural wind instruments like natural flutes, the head pipe section is rotatable relative to the main pipe section. Thus, some human players of flutes and the like execute a performance in their desired style by rotating the head pipe section relative to the main pipe section to not only contact its lower jaw with a desired position of the lip plate but also orient the mouthpiece in a desired direction. However, in many wind instruments, the head pipe section is not rotatable relative to the main pipe section, and thus, there would arise the problem that it is not possible to adjust the lower-jaw contacting position of the lip plate and the orientation of the blow hole. With the electronic wind instrument disclosed in the No. 2007-17524 publication, the blow hole opening toward the guide member can be changed because the guide member is movable along the rail; however, it is not possible to adjust the postures of the blow hole and lip plate in the same manner as the head pipe section is rotated relative to the main pipe section in natural flutes etc. More specifically, even when the head pipe section is rotated relative to the main pipe section in natural flutes etc., the relative position and orientation of the blow hole relative to the lip plate do not change in traditional electronic flutes etc. However, in the electronic wind instrument disclosed in the No. 2007-17524 publication, the relative position and orientation of the blow hole relative to the lip plate change as the guide member is moved along the curved rail. Thus, with the electronic wind instrument disclosed in the No. 2007-17524 publication, the postural adjustment of the blow hole and lip plate, executable in wind instruments like natural flutes, can never be reproduced.

SUMMARY OF THE INVENTION

In view of the foregoing, it is an object of the present invention to provide an improved electronic wind instrument in which the positions and orientations of the blow hole and lip plate can be adjusted in the same manner as the head pipe section is rotated relative to the main pipe section in natural wind instruments, such as natural flutes.

In order to accomplish the above-mentioned object, the present invention provides an improved electronic wind instrument, which comprises: a body section; and a blowing unit pivotably supported on the body section. The blowing unit includes a lip plate section that abuts with a lower lip part of a human player, and a blowing detection section that detects a flow rate of a breath blown by the human player.

According to the present invention, the blowing unit, supporting the lip plate section and blowing detection section, is pivotable, and thus, the blow hole and lip plate can be adjusted in position and orientation without the orientation and position of the blow hole relative to the lip plate section being changed.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

Figure 1:
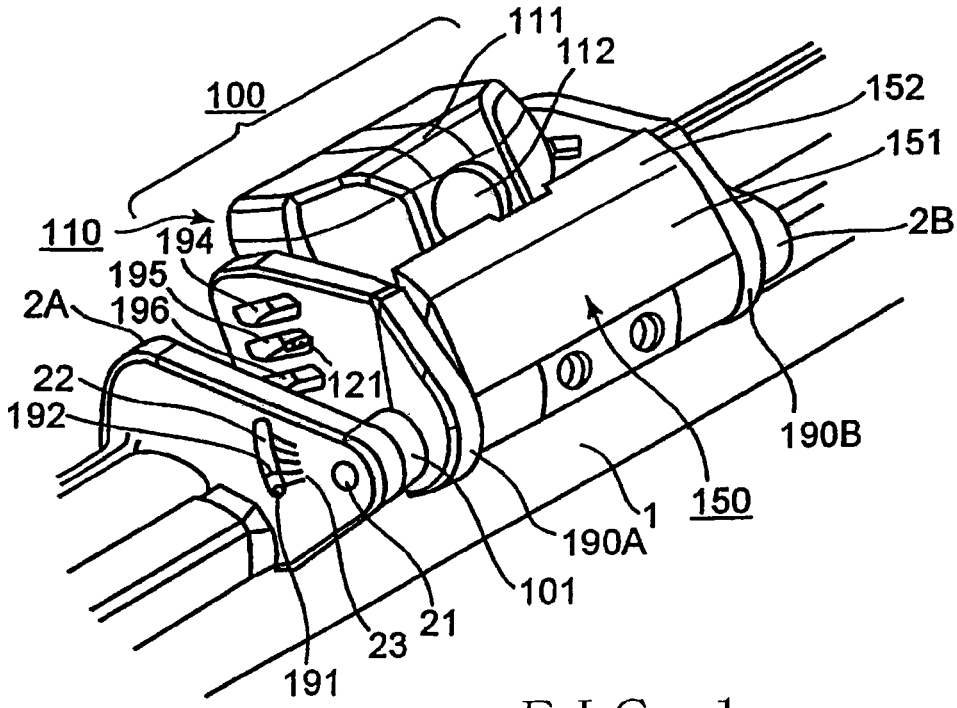
FIG. 1 is a perspective view showing an example construction of a blowing unit of an electronic flute which is an embodiment of an electronic wind instrument of the present invention.
Figure 2:
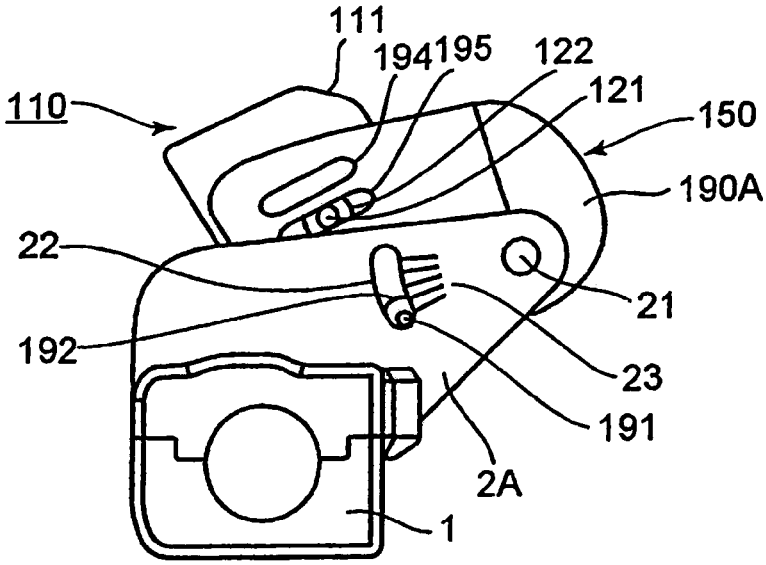
FIG. 2 is a side view of the construction shown in FIG. 1.
Figure 3:
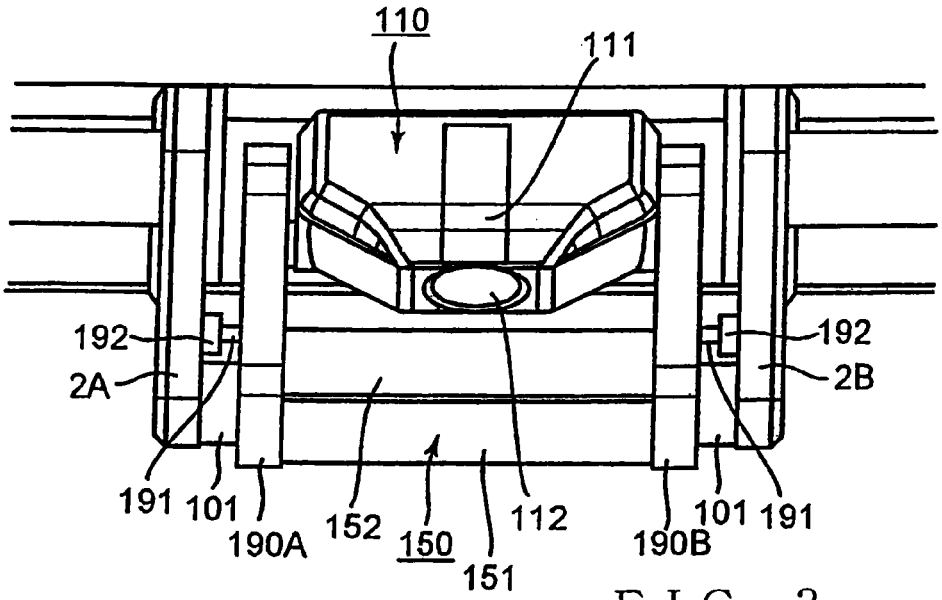
FIG. 3 is a plan view of the construction shown in FIG. 1.
Figure 4:
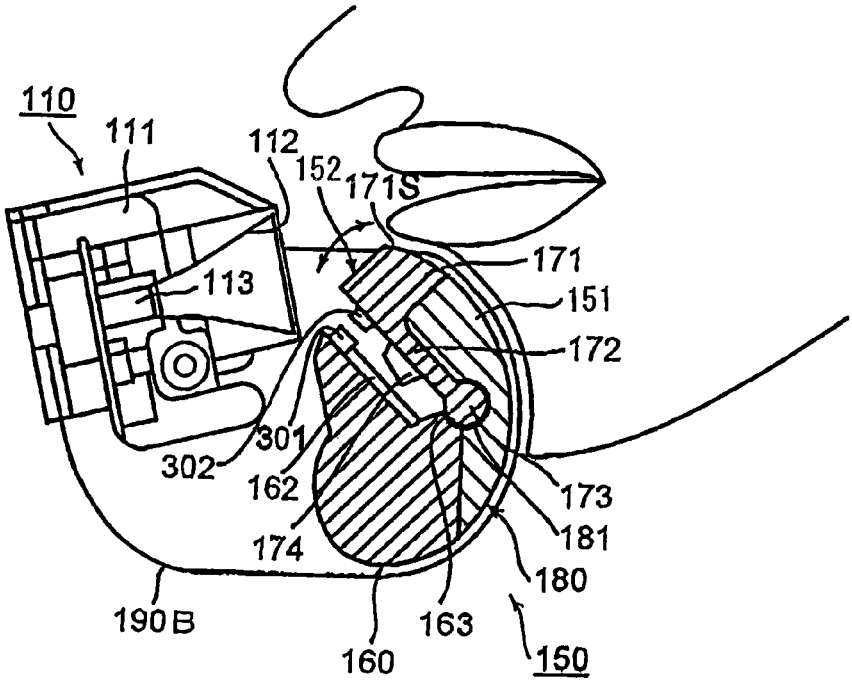
FIG. 4 is a sectional view of the blowing unit.

FIG. 1 is a perspective view showing an example construction of a blowing unit 100 and sections therearound of an electronic flute which is an embodiment of an electronic wind instrument of the present invention. FIG. 2 is a side view of the blowing unit 100 taken from a top side of a head pipe section of the electronic flute, FIG. 3 is a plan view of the blowing unit 100, and FIG. 4 is a sectional view of the blowing unit 100 As shown in the figures, two flanges 2A and 2B are fixed to the head pipe section 1 of the electronic flute and spaced apart from each other at a predetermined interval in an axial direction (longitudinal direction) of a tubular body section of the flute. The blowing unit 100 has pivot shafts 101 that are supported by respective bearings 21 provided on the flanges 2A and 2B (only the bearing 21 of the flange 2A is shown in FIG. 1). With such arrangements, the blowing unit 100 in the instant embodiment can be caused to pivot about the pivot shafts 101 by applying a certain external force. The body section of the electronic flute according to the instant embodiment comprises three major sections: the head pipe section 1; main pipe section (not shown); and foot (tail) pipe section (not shown), and the blowing unit, performing keys, tone generator device, etc. are disposed on or contained in given portions of the body section.

The blowing unit 100 generally comprises a blowing detection section 110, lip plate section 150, and side plate sections 190A and 190B fixedly sandwiching therebetween these blowing detection section 110 and lip plate section 150 from axial opposite sides of the head pipe section 1. The above-mentioned pivot shafts 101 are fixed to the side plate sections 190A and 190B, respectively.

Pin 191 projects from the side plate section 190A, and a stopper 192 is provided on an intermediate portion of the pin 191 and projects radially from the pin 191 like a flange. Further, a not-shown mechanism for adjusting a projecting length of the pint 191 is provided on the side plate section 190A. The flange 2A has an elongated guide groove 22 is formed in the flange 2A along a trajectory drawn by the pin 191 as the blowing unit 100 is pivoted about the pivot shaft 101. The pin 191 has a distal end portion inserted in the elongated guide groove 22. By increasing the projecting length of the pin 191 to press the stopper 192 against the inner side surface of the flange 2A, the side plate section 190A of the blowing unit 100 can be fixed to the flange 2A. Scale marks 23 for indicating a current position of the pin 191 (i.e., current pivoting position of the blowing unit 100) are provided (e.g., printed) on the flange 2A adjacent to one side of the guide groove 22. Similar pin 191, stopper 192, guide groove 22 and scale marks 23 are provided on the other side plate section 190B and flange 2B. These elements 2A, 22, 191 and 192 are elements that function to retain the blowing unit 100 at a desired pivoting position.

Upper-lip proximity sensor 111 for measuring a distance to the upper lip of the human player is provided on an upper portion of the blowing detection section 110, and this upper-lip proximity sensor 111 is, for example, in the form of an infrared reflector. Cone-shaped jet collector 112 is provided on a front surface portion, opposed to the lips of the human player, of the blowing detection section 110. The jet collector 112 functions to collect a breath (air jet) blown from the mouth of the human player and direct the collected breath to a jet flow rate sensor 113 provided within the blowing detection section 110. The jet flow rate sensor 113 is in the form of a pressure sensor. In the blowing detection section 110, the jet collector 112 and upper-lip proximity sensor 111 are oriented in the same direction, and when the player's mouth is straight in front of the jet collector 112 so that the jet collector 112 can efficiently capture a player's breath, the upper-lip proximity sensor 111 too can sense the player's upper lip right from its front and thus can accurately detect a distance to the upper lip.

Pivot shafts 121 project outwardly from the opposite sides of the blowing detection section 110, and a flange-shaped stopper 122 is provided on an intermediate portion of the pivot shaft 121. Mechanism for adjusting the projecting length of the pivot shaft 121 is provided on the blowing detection section 110, although not particularly shown. Three horizontally elongated guide grooves 194, 195 and 196 are formed, as pivot shaft bearing portions, in each of the side plate sections 190A and 190B. The user can use any one of the guide grooves 194, 195 and 196 to fix the blowing detection section 110 at a desired angle at a desired position along the length of the elongated guide groove, in accordance with the following operational sequence.

First, the blowing detection section 110 is inserted between the side plate sections 190A and 190B by contracting or decreasing the projecting length of each of the pivot shafts 121. Then, the pivot shafts 121 of the blowing detection section 110 are each positioned at a desired one of the guide grooves 194, 195 and 196 in each of the side plate sections 190A and 190B, and then the projecting length of each of the pivot shafts 121 is increased so that distal end portions of the pivot shafts 121 are inserted in the desired side plate sections 190A and 190B. After that, the pivot shafts 121 are moved along the corresponding guide grooves and thereby adjusted in position within the corresponding grooves, and thus, the blowing detection section 110 is adjusted in rotational angle. After such adjustment, the projecting length of each of the pivot shafts 121 is further increased so that the stoppers 122 of the pivot shafts 122 are pressed against the inner side surfaces of the corresponding side plate sections 190 and 190B to thereby fix the blowing detection section 110 between the side plate sections 190A and 190B. In this way, it is possible to adjust a distance and angle of the blowing detection section 110 relative to the lip plate section 150.

The lip plate section 150 is fixed at its opposite ends in the axial direction of the pipe to the side plate sections 190A and 190B. The lip plate section 150 includes a fixed, non-movable lower lip plate portion 151, and a movable upper lip plate portion 152. Here, the upper lip plate portion 152 is a portion for abutment with the lower lip part (i.e., lower lip and neighboring part) of the human player and movable toward the center line of the head pipe section 1 in response to a pressing force applied from the lower lip part of the human player. Lip pressure sensor 162S is disposed within the lip plate section 150, which receives the pressure from the lower lip part of the human player to generate a signal corresponding to the received pressure.

As shown in FIG. 4, the upper lip plate portion 152 includes a lip abutting portion 171 having a lip abutting surface 171S projecting toward the human player's mouth at the time of a performance of the electronic flute, and a plate portion 172 projecting from the lip abutting portion 171, and a pivot shaft 173 of a cylindrical columnar shape formed at the distal end of the plate portion 172. Surface of the upper lip plate portion 152 opposite from the lip abutting surface 171S is opposed to a pressure-sensitive resistor 162 with a predetermined interval therebetween, and a pressing portion 174 projecting toward the pressure-sensitive resistor 162 is provided on that surface of the upper lip plate portion 152. The pressing portion 174 is formed, for example, of a resilient substance such as rubber. While the upper lip plate portion 152 is not being pressed by the lower lip part of the human player, the pressing portion 174 is kept away from the pressure-sensitive resistor 162.

The lower lip plate portion 151 is a curved member having a front surface gently bulging outwardly and having a rear surface where is formed a recessed portion 181 receiving therein the pivot shaft 173 of the upper lip plate portion 152. Bearing base too has a recessed portion 163 receiving therein the pivot shaft 173. Here, the bearing base 160 is fixed at its opposite sides in the axial direction of the pipe to the side plate sections 190A and 190B (see FIG. 1). As shown in FIG. 4, the bearing base 160 has a flat surface portion that faces the human player's mouth located obliquely above at the time of a performance of the electronic wind instrument, and the sheet-shaped pressure-sensitive resistance 162 is fixed to the flat surface portion. The recessed portion 181 of the lower lip plate portion 151 constitutes a bearing hole in conjunction with the recessed portion 163 of the bearing base 160, and this bearing hole pivotably supports the pivot shaft 173 of the lower lip plate portion 151. The upper lip plate portion 152, having the pivot shaft 173 supported in the bearing hole, pivots toward the pressure-sensitive resistor 162 by being pressed by the lower lip part of the human player, in response to which the top surface of the pressure-sensitive resistance 162 is movable up to the surface of the pressing portion 174. The top surface of the pressing portion 174 slightly slants relative to the pressure-sensitive resistance 162 of the upper lip plate portion 152 so that the top surface is brought into face-to-face contact with the pressure-sensitive resistance 162 when it reaches the pressure-sensitive resistance 162 as the upper lip plate portion 152 pivots.

Permanent magnet 301 is fixed to a surface portion of the bearing base 160 where the pressure-sensitive resistance 162 is not located. Further, a permanent magnet 302 is fixed to a surface portion of the upper lip plate portion 152 opposite from the lip abutting surface 171S, and it is opposed to the permanent magnet 301. These permanent magnets 301 and 302 repel each other with the N and S poles of one of the permanent magnets 301 and 302 opposed to the N and S poles of the other permanent magnets 302 and 301, and such a repelling force serves as a force normally urging the upper lip plate portion 152 in a direction away from the pressure-sensitive resistance 162. The pressure-sensitive resistance 162 constitutes the lip pressure sensor 162S When a shift is to be made from one octave to another, the human player subtly moves its lower jaw in a front-rear direction. Once the human player moves forward its lower jaw with the lower lip part of the player abutted against the lip abutting surface 171S, torque is applied form the lower lip part to the upper lip plate portion 152 so that the upper lip plate portion 152 is moved toward the pressure-sensitive resistance 162. Then, once the pressing member 174 hits the pressure-sensitive resistance 162, an octave shift instruction is generated in response to an output from the lip pressure sensor 162S.

The forgoing are structural details of the blowing unit 100 according to the instant embodiment of the present invention.

Figure 5:
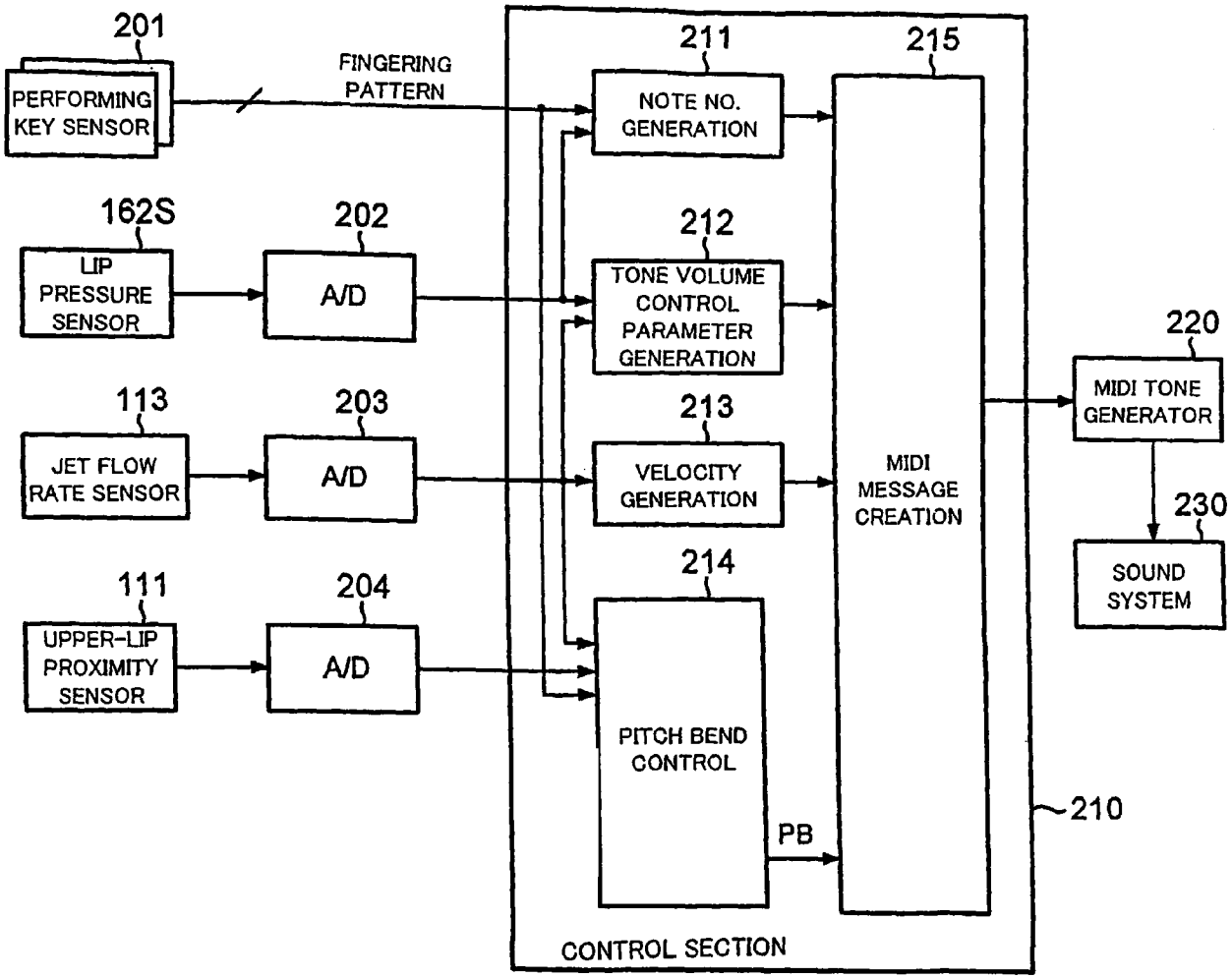
FIG. 5 is a block diagram showing an electrical construction of the electronic flute.

FIG. 5 is a block diagram showing an electrical construction of the electronic wind instrument according to the instant embodiment of the present invention. In FIG. 5, a plurality of performing key sensors 201 are sensors for detecting respective states of the performing keys (not shown) provided on the main pipe section and foot pipe section of the electronic flute. With these performing key sensors 201, there is generated a fingering pattern indicative of whether the performing keys are in the ON position (in which the keys are being depressed to close tone holes of the main pipe section and foot pipe section) or in the OFF position, and the fingering pattern is supplied to a control section 210.

The lip pressure sensor 162S is a sensor that receives a pressure applied through the upper-lip plate portion 152 shown in FIGS. 1-3 and outputs an analog signal of a voltage value corresponding to a value of the received pressure. Jet flow rate sensor 113 is a pressure sensor that outputs a signal indicative of a flow rate of a blown breath collected by the cone-shaped jet collector 112 shown in FIGS. 1 and 3. The upper-lip proximity sensor 111 has already been explained above in relation to FIGS. 1-3.

A/D converts 202, 203 and 204 convert analog signals, from the corresponding lip pressure sensor 162S, jet flow rate sensor 113 and upper-lip proximity sensor 111 into a digital lip pressure signal, breath flow rate signal and distance-to-upper-lip signal, respectively, which are output to the control section 210.

The control section 210 is a device for controlling various components, such as a subsequent-stage MIDI tone generator 220, of the electronic flute. The control section 210 comprises, for example, a CPU, a RAM to be used as a working area by the CPU, and a ROM having stored therein various tables to be referred to by the CPU and various programs to be executed by the CPU, although not specifically shown. FIG. 5 shows various processes performed by the CPU of the control section 210 in accordance with the programs stored in the ROM.

The various processes performed by the control section 210 include a process for generating parameters that become constituent elements of a MIDI message, such as a note number, expression value and breath control value, for controlling the MIDI tone generator 220.

On the basis of a fingering pattern given from the performing key sensors 201, a note number generation process 211 calculates a note number of a tone signal to be generated by the MIDI tone generator 220. Further, the note number generation process 211 compares the lip pressure signal against a threshold value. If the lip pressure signal has exceeded the threshold value, it is considered that the human player has moved his or her lower jaw to instruct an octave shift, so that a note number determined on the basis of the fingering patter is shifted to a note number one octave higher than the determined note number.

Tone volume control parameter generation process 212 is a process for determining an expression value or breath control value, which is a tone volume control parameter, on the basis of a lip pressure signal and breath flow rate signal given from the A/D converter 203. Velocity generation process 213 is a process for determining a velocity indicative of an intensity of a tone at a rising phase on the basis of the breath flow rate signal given from the A/D converter 203.

Pitch bend control process 214 is a process for determining a pitch bend value PB on the basis of the breath flow rate signal given from the A/D converter 203 and distance-to-upper-lip signal given from the A/D converter 204. More specifically, when the distance from the upper lip of the human player to the upper-lip proximity sensor 111, indicated by the distance-to-upper-lip signal has decreased, the pitch bend control process 214 generates a pitch-lowering pitch bend value PB in accordance with a degree of the distance decrease.

MIDI message creation process 215 is a process for creating a MIDI message using the parameters generated through the aforementioned processes and sending the thus-created MIDI message to the MIDI tone generator 220. More specifically, once the value of the breath flow rate signal given from the A/D converter 203 exceeds a threshold value and a note-ON condition is satisfied, the MIDI message creation process 215 creates a note-ON message using a note number currently given from the note number generation process 211 and a velocity value currently given from the velocity generation process 213 and then transmits the thus-created note-ON message.

The note-ON state lasts as long as the value of the breath flow rate signal is greater than the threshold value and the same fingering pattern is maintained. During the note-ON period, the MIDI message creation process 215 creates a control change message using the expression value or breath control value given from the tone volume control parameter generation process 212 and then transmits the thus-created control change message to the MIDI tone generator 220. Further, once the human player subtly moves its lower jaw to instruct an octave shift, the note number generation process 211 detects the octave shift instruction on the basis of the lip pressure signal and changes the note number to another or new note number in accordance with the detected octave shift instruction. In such a case, the MIDI message creation process 215 creates a MIDI message instructing a change to the new note number and then sends the thus-created control change message to the MIDI tone generator 220. Further, once the human player rotates the tubular body section of the electronic flute toward himself or herself during the note-ON period, the distance from the upper-lip proximity sensor 111 to the upper lip of the human player, indicated by the distance-to-upper-lip signal, gets shorter, so that the pitch bend control process 214 generates a pitch bend value PB corresponding to a degree of the shortening of the distance from the upper-lip proximity sensor 111 to the upper lip. Further, in this case, the MIDI message creation process 215 creates a pitch bend message using the pitch bend value PB given from the pitch bend control process 214 and then transmits the thus-created pitch bend message to the MIDI tone generator 220. Then, once the value of the breath flow rate signal falls below the threshold vales or the fingering pattern changes, the MIDI message creation process 215 transmits, to the MIDI tone generator 220, a note-OFF message to terminate the tone signal having so far been in the note-ON state.

The MIDI tone generator 220 is a device for generating a digital tone signal in accordance with the MIDI message transmitted from the control section 210 in the aforementioned manner. Sound system 230 includes a D/A converter for converting the tone signal, output from the MIDI tone generator 220, into an analog tone signal, an amplifier for amplifying the analog tone signal, and a speaker driven by the amplifier (not shown).

According to the above-described embodiment, where the blowing unit 100 integrally including the blowing detection section 110 and lip plate section 150, is pivotable about the pivot shaft 101, the human player can make adjustments on the electronic flute similar to those made on natural wind instruments by rotating the head pipe section relative to the main pipe section. Further, when an octave shift is to be instructed, the position on the lip plate section 150 the lower jaw should contact to perform this octave shift instructing operation tends to differ among human players; however, the instant embodiment can appropriately deal with the octave shift instructing operation irrespective of the position on the lip plate section 150 the lower jaw contacts or abuts against. Namely, the instant embodiment, which allows the blowing detection section 110 to pivot relative to the blowing unit 100 to thereby independently adjust the orientation of the jet collector 112, it can optimize the orientation of the jet collector 112 so as to efficiently take in a human player's breath while absorbing player-specific variation in the lower-jaw-abutting position on the lip plate section 150. Further, according to the above-described embodiment, where the upper-lip proximity sensor 111 is provided in the blowing detection section 110 along with the jet collector 112, the orientation of the upper-lip proximity sensor 111 too can be automatically optimized, in response to the orientation optimization of the upper-lip proximity sensor 111 to efficiently take in the human player's breath, so as to detect the human player's upper lip straight in front thereof. Thus, the instant embodiment can advantageously eliminate a need for positionally adjusting the upper-lip proximity sensor 111. Furthermore, because the pivot shafts 121 of the blowing detection section 110 are supported in the horizontal elongated guide grooves in the instant embodiment, the instant embodiment can advantageously adjust the distance from the jet collector 112 and upper-lip proximity sensor 111 to the player's mouth and adjust the tone volume and degree of the pitch bend. Furthermore, because a plurality of the guide grooves for supporting the pivot shafts 121 of the blowing detection section 110 are provided in vertically spaced-apart relation to one another, the instant embodiment can advantageously adjust the height of the blowing detection section 110 as desired by the human player.

Other embodiments than the above-described embodiment are also possible as set forth below by way of example.

(1) Whereas the above-described embodiment is constructed to permit angular and positional adjustments of the blowing detection section 110, the blowing detection section 110 may be fixed to the side plate sections 190A and 190B.

(2) The blowing detection section 110 may be constructed so that only its position is adjustable with its angle fixed.

(3) The blowing detection section 110 may be constructed so that only its angle is adjustable with its position fixed.

Figure 6A:
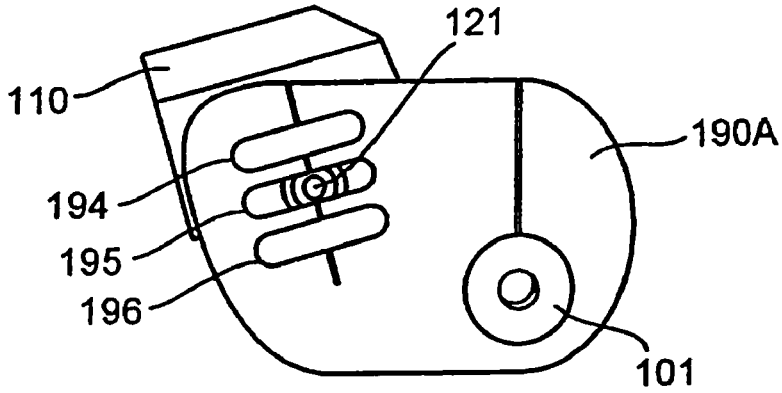
FIGS. 6A-6C are side views of several other examples of constructions of the blowing unit.
Figure 6B:
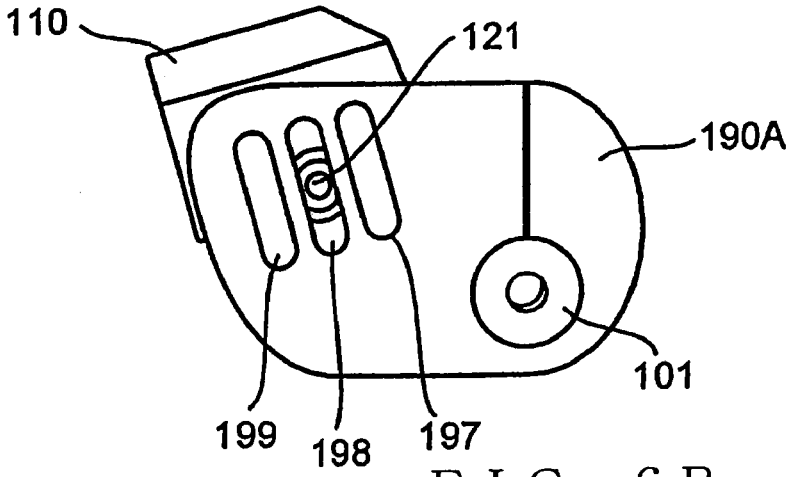
Figure 6C:
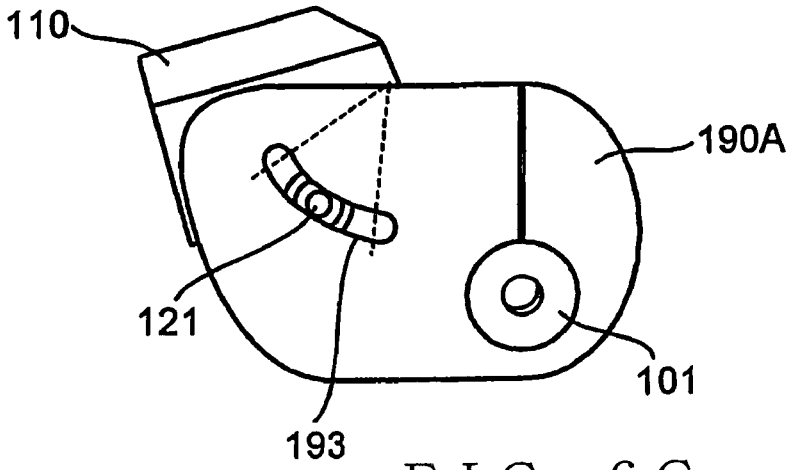

(4) The blowing detection section 110 may be supported in various manners. In the above-described embodiment, the three horizontal guide grooves 194, 195 and 196 are provided in each of the side plate sections 190A and 190B for pivotably supporting the blowing detection section 110, as shown in FIG. 6A. Alternatively, three vertical guide grooves 197, 198 and 199 may be provided in each of the side plate sections 190A and 190B, as shown in FIG. 6B. In another alternative, a guide groove 193 extending along an arcuate trajectory about a breath inlet of the jet collector 112 may be provided in each of the side plate sections 190A and 190B, as shown in FIG. 6C. In such a case, the angle of the blowing detection section 110 can be adjusted with the breath inlet of the jet collector 112 positionally fixed.

(5) Whereas the upper-lip proximity sensor 111 is positionally fixed to the jet collector 112 in the above-described embodiment, arrangements may be made to allow that the upper-lip proximity sensor 111 to be positionally adjusted relative to the jet collector 112 independently of the jet collector 112.

This application is based on, and claims priority to, JP PA 2007-162451 filed on 20 Jun. 2007. The disclosure of the priority applications, in its entirety, including the drawings, claims, and the specification thereof, is incorporated herein by reference.

What is claimed is:

1. An electronic wind instrument comprising:
a body section; and
a blowing unit pivotably supported on said body section, said blowing unit including:
a lip plate section that abuts with a lower lip part of a human player; and
a blowing detection section that detects a flow rate of a breath blown by the human player, wherein said blowing detection section includes an upper-lip proximity sensor that detects a distance to an upper lip of the human player.

2. The electronic wind instrument as claimed in claim 1 wherein said lip plate section includes a lip pressure sensor that detects a pressure received from the lower lip part of the human player.

3. The electronic wind instrument as claimed in claim 1 wherein said body section is simulative of a body of a flute.

4. An electronic wind instrument comprising:
a body section; and
a blowing unit pivotably supported on said body section, said blowing unit including:
a lip plate section that abuts with lower lip part of a human player; and
a blowing detection section that detects a flow rate of a breath blown by the human player, wherein said blowing unit includes side plate sections that fixes said lip plate section and supports said blowing detection section in such a manner that said blowing detection section is pivotable about a pivot shaft parallel to a shaft rotatably supporting said blowing unit relative to said body section.

5. The electronic wind instrument as claimed in claim 4 wherein each of said side plate sections has one or more elongated bearing portions that receive the pivot shaft of said blowing detection section.

6. An electronic wind instrument comprising:

a body section; and a blowing unit pivotably supported on said body section, said blowing unit including:

a lip plate section that abuts with a lower lip part of a human player; and a blowing detection section that detects a flow rate of a breath blown by the human player, wherein said blowing unit is pivotable about a longitudinal shaft of said body section.

7. The electronic wind instrument as claimed in claim 6 which includes retaining elements that retain said blowing unit at a predetermined pivoting position.

8. The electronic wind instrument as claimed in claim 7 which includes scale marks for indicating a pivoting position of said blowing unit retained by said retaining elements.

9. An electronic wind instrument comprising:

a body section;

a blowing unit pivotably supported on said body section, and blowing unit including:

a lip plate section that abuts with a lower lip part of a human player, said lip plate section including a lower lip plate portion and an upper lip plate portion movable relative to the lower lip plate portion in response to pressing by the lower lip part of the human player and a pressing-detecting sensor that detects when the upper lip plate portion is pressed and instructs an octave shift in accordance with an output of said pressing-detecting sensor.

* * * * *